US007118242B1

(12) United States Patent
Yulee

(10) Patent No.: US 7,118,242 B1
(45) Date of Patent: Oct. 10, 2006

(54) RELIGIOUS LAMP WITH FLUID FLOW

(76) Inventor: Joyce Yulee, 712 29th St., Niceville, FL (US) 32578

( * ) Notice: Subject to any disclaimer, the term of this patent is extended or adjusted under 35 U.S.C. 154(b) by 40 days.

(21) Appl. No.: 10/932,217

(22) Filed: Sep. 2, 2004

(51) Int. Cl.
*F21S 6/00* (2006.01)

(52) U.S. Cl. ..... 362/121; 362/808; 362/96

(58) Field of Classification Search ..... 362/121, 362/124, 101, 96, 253, 269, 271, 285, 806, 362/808
See application file for complete search history.

(56) References Cited

U.S. PATENT DOCUMENTS

| | | | | |
|---|---|---|---|---|
| D65,118 | S | 7/1924 | Johnsen | |
| 1,614,703 | A | 1/1927 | Wolfers | |
| D86,245 | S | 2/1932 | Lehmann | |
| 2,036,616 | A | 4/1936 | Asch | |
| 2,114,194 | A | 4/1938 | Sadacca | |
| 2,325,883 | A | 8/1943 | Schleif | |
| 2,493,996 | A | 1/1950 | Morrison | |
| 2,729,024 | A | 1/1956 | Guttman | |
| 2,771,543 | A | 11/1956 | Seisholtz, Jr. | |
| 3,174,688 | A * | 3/1965 | Chatten | 239/20 |
| D204,411 | S | 4/1966 | Shirley | |
| D205,410 | S | 8/1966 | Gerlut | |
| D213,463 | S | 3/1969 | Davis | |
| 3,930,334 | A * | 1/1976 | Johnston | 47/67 |
| 4,375,733 | A | 3/1983 | Callais, Jr. | |
| D338,081 | S | 8/1993 | Klaffer | |
| 5,255,170 | A | 10/1993 | Plamp et al. | |
| 5,456,625 | A * | 10/1995 | Dumond | 446/268 |
| D370,282 | S | 5/1996 | Grether | |
| D398,408 | S | 9/1998 | Lin | |
| 5,957,747 | A | 9/1999 | Liggitt | |
| 6,093,475 | A * | 7/2000 | Geller | 428/166 |
| D429,351 | S | 8/2000 | Grether | |
| D456,556 | S | 4/2002 | Pahl et al. | |
| 6,491,516 | B1 * | 12/2002 | Tal et al. | 431/253 |
| D483,894 | S | 12/2003 | Freeman | |

* cited by examiner

*Primary Examiner*—Renee Luebke
*Assistant Examiner*—Julie A. Shallenberger
(74) *Attorney, Agent, or Firm*—Peter Loffler

(57) ABSTRACT

A religious lamp has a base with a cross extending upwardly. A body of Jesus is crucified upon the cross, the head of Jesus tilting upwardly whenever the lamp is energized and tilts downwardly whenever the lamp is deenergized. A solenoid controls up and down tilting of the head of Jesus. A fluid flow system circulates simulated blood out through the body of Jesus. The fluid flow system is either a closed loop tube through which the simulated blood passes or is an open drip wire system wherein a pump pumps the simulated blood to the top of the drip wires and the simulated blood drips down the wires and is collected in a reservoir to be recirculated.

18 Claims, 3 Drawing Sheets

RELIGIOUS LAMP WITH FLUID FLOW

BACKGROUND OF THE INVENTION

1. Field of the Invention

The present invention relates to a religious lamp, namely Jesus crucified on the cross, which lamp has a fluid flow mechanism to simulate blood flow from Jesus' body and wherein Jesus' head rises with light actuation and falls with light extinguishment.

2. Background of the Prior Art

Religion is a practiced the world over in many forms. While some people may attend church (temple, etc.,) on Sundays (or other days depending on faith) and read the bible, many more are fully ingrained with religion as a complete way of life that dominates almost every aspect of a person's life. Not only do people attend religious services regularly, people also practice their faith during every day events and in almost every occasion.

One form of religious practice outside a house of faith is to display various religious articles. Such displays include wearing religious clothing and jewelry, having appropriate religious displays on a person's vehicle, having religious symbols displayed around the house, office, etc. The Christian faith has many symbols that display and speak of Christianity. Such symbols include crosses, angels, the Virgin Mary, Jesus fish, etc., however, there is one symbol that rises above all others as an extremely powerful display, that being Jesus himself. Jesus, the King of the Jews, is the savior of Christianity. He is the son of God who was sent to earth in order to die for the sins of others. One of the most powerful displays of Jesus is his crucifixion upon the cross. This symbol evokes powerful emotion from those seeing it.

There are many displays that feature Jesus crucified upon the cross. Typically, such displays include paintings or actual crosses bearing a body in the likeness of Jesus, each of these being hung on the wall. Applicant has found a need for more active displays of Jesus being crucified upon the cross, which displays attract a person's attention to the display and thereby evoke the emotions that the display is designed to bring forth. Such an active display should be useful about a house, office, or place of worship, and should be relatively simple in design and construction so that it is relatively inexpensive for purchase to a wide array of believers.

SUMMARY OF THE INVENTION

The religious lamp with fluid flow of the present invention addresses the aforementioned needs in the art. The religious lamp with fluid flow provides active displays of Jesus being crucified upon the cross, which naturally attract a person's attention to the display in order to evoke the emotions that the display is designed to bring forth. The religious lamp with fluid flow is useful about a house, place of worship, or office, and is relatively simple in design and construction making the device relatively inexpensive for purchase to a wide array of believers.

The religious lamp with fluid flow is comprised of a base with a cross extending upwardly from the base. A body of a human, namely Jesus, is crucified upon the cross. A light bulb is attached to the display, the light bulb being electrically connected to a source of electrical power for energizing the light bulb. The head of the body of Jesus tilts upwardly whenever the light bulb is energized and tilts downwardly whenever the light bulb is not energized. A solenoid controls the tilting of the head of the body of Jesus, the solenoid being electrically connected with the light bulb. An on/off switch is disposed between the light bulb and the source of electrical power for controlling the electrical communication between the light bulb and the source of electrical power. One or more fluid flow systems circulates a fluid therethrough and causes the fluid to pass out through a point of the body of Jesus. The fluid flow system may comprise a closed loop tube that passes through the point of the body of Jesus and a pump that pumps the fluid through the tube, the pump being connected to the source of electrical power. The fluid flow system may also comprise a reservoir for holding the fluid, a tube that leads to a top of the body of Jesus, one or more drip wires that are fluid flow connected to the tube, the drip wires passing through points of the body of Jesus and terminating at the reservoir, a pump that pumps the fluid from the reservoir and through the tube, the pump being connected to the source of electrical power, and wherein the pump pumps the fluid from the reservoir and up through the tube to the drip wires wherein the fluid drips down the drip wire and collects in the reservoir.

BRIEF DESCRIPTION OF THE DRAWINGS

Similar reference numerals refer to similar parts throughout the several views of the drawings.

DESCRIPTION OF THE PREFERRED EMBODIMENT

Figure 1:
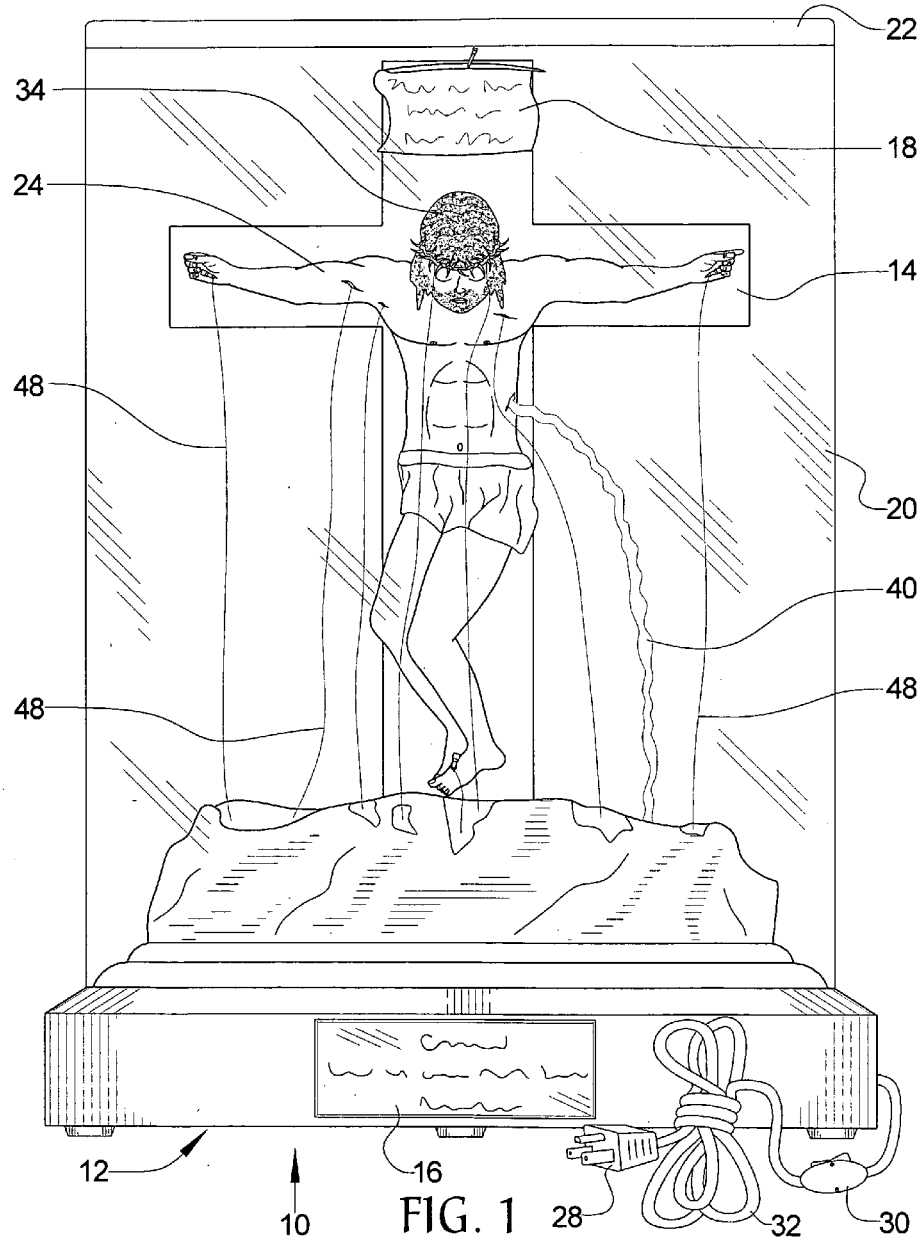
FIG. 1 is an elevation view of the religious lamp with fluid flow of the present invention.

Referring now to the drawings, it is seen that the religious lamp with fluid flow of the present invention, generally denoted by reference numeral 10, is comprised of is base 12 with a cross 14 extending upwardly from the base 12. The base 12 may have any appropriate shape and design and may have a desired saying 16 placed thereon. Likewise, the cross 14 may have any appropriate design and may also have an appropriate saying 18 therein. A clear enclosure 20 extends upward from the base 12 and has a top 22 thereon. A body 24 of a human, namely Jesus, is crucified upon the cross 14. A light bulb 26 is attached to the top 22, the light bulb 26 being electrically connected to a source of electrical power (not illustrated) by a standard plug 28 for energizing the light bulb 26. An appropriate on/off switch 30 may be located on the cord 32 of the plug 28 or at any other desired spot such as on the base 12, the cross 14, or the top 22. If desired, the light bulb 26 as well as the other electrical components described infra, may be powered by batteries (not illustrated), although regular wall outlet power is preferred.

Figure 2:
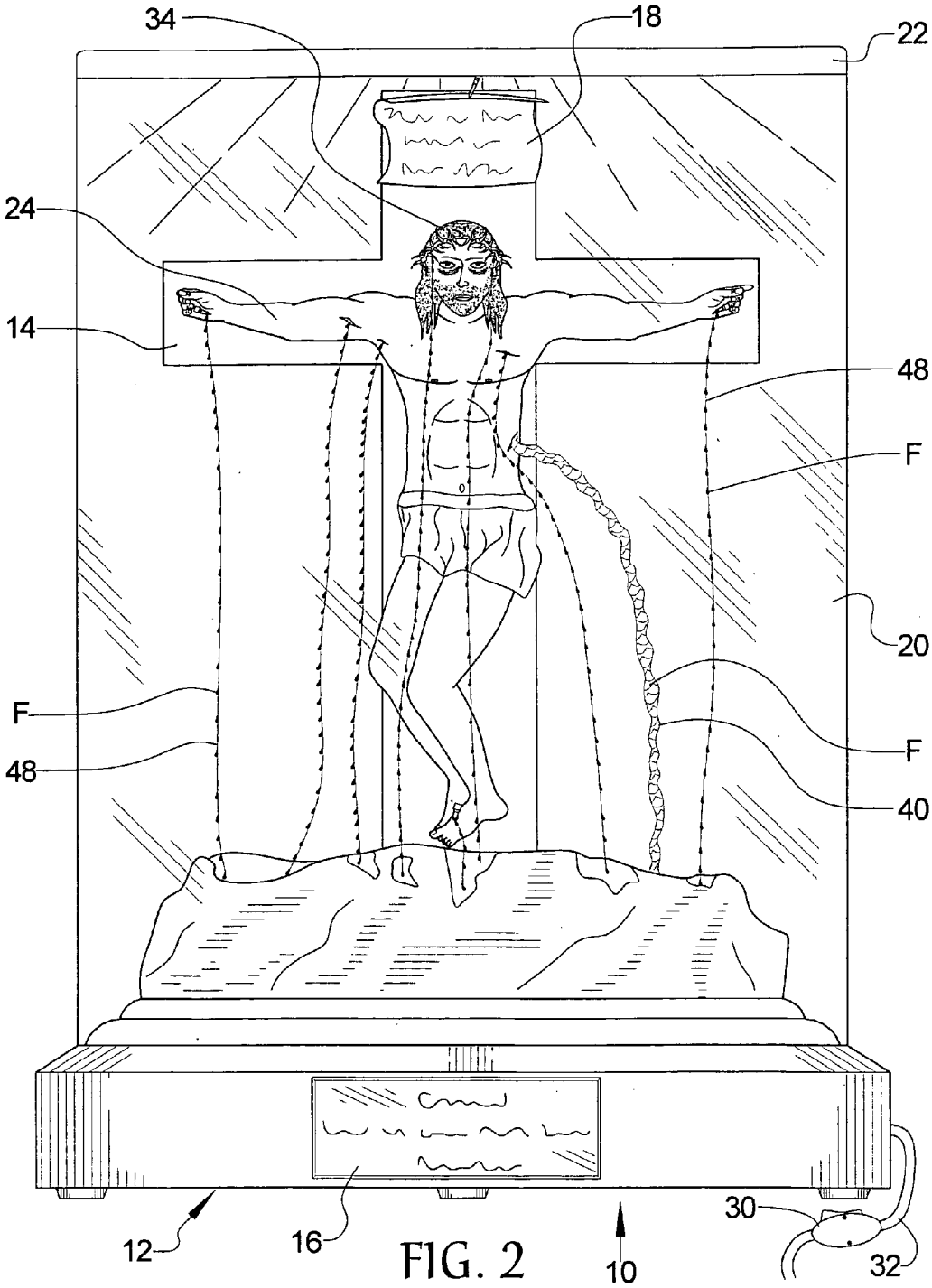
FIG. 2 is an elevation view of the religious lamp with fluid flow in an energized state.
Figure 3:
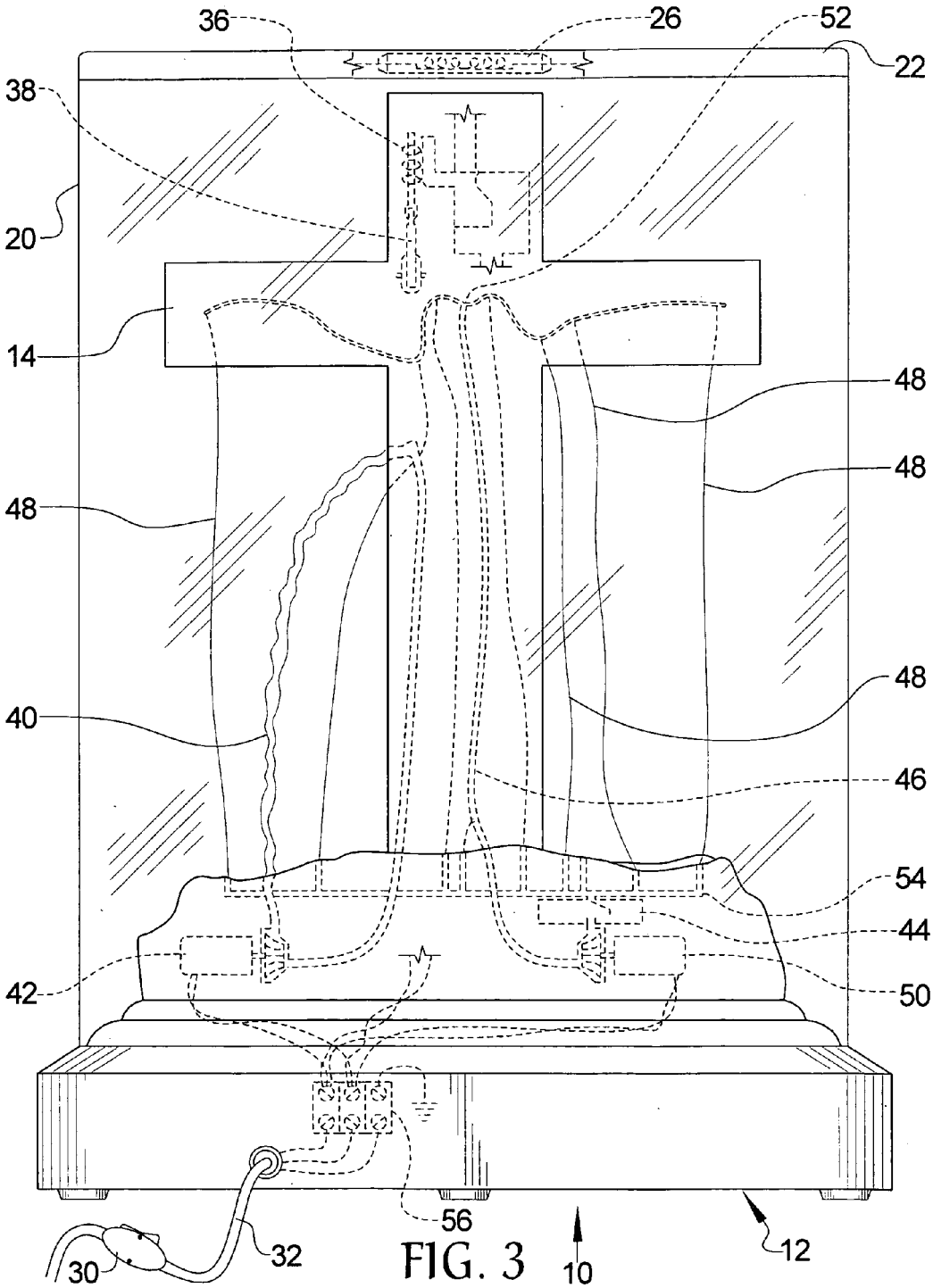
FIG. 3 is an elevation view of the religious lamp with fluid flow illustrating the internal components.

The head 34 of the body 24 of Jesus is pivotally attached to the rest of his body 24 and tilts upwardly whenever the light bulb 26 is energized (as illustrated in FIG. 2) and tilts downwardly whenever the light bulb 26 is not energized (as illustrated in FIG. 1). A solenoid 36 controls the tilting of the head 34 of the body 24 of Jesus, the solenoid 36 being electrically connected with the light bulb 26. An appropriate tilt linkage 38 is connected between the solenoid 36 and the head 34 of Jesus 24 such that whenever the light bulb 26 is energized, the solenoid 36 activates to tilt the head 34 of Jesus upwardly via the tilt linkage 38 and whenever the light bulb 26 is turned off, the solenoid deactivates and causes the head 34 of Jesus 24 to tilt downwardly via the tilt linkage 38. It is expressly recognized that various other methods can be employed to achieve the up and down tilting of the head 34 of Jesus 24, such as the use of bi-metal strips, etc., in keeping within the scope of the present invention.

One or more fluid flow systems circulates a fluid therethrough and causes the fluid F to pass out through a point of the body 24 of Jesus. The fluid flow system may either comprise a closed loop first tube 40 that passes through one or more points of the body 24 of Jesus and a first pump 42 that pumps the fluid F through the first tube 40, the first pump 42 being connected to the source of electrical power. The fluid flow system may also comprise a reservoir 44 for holding the fluid F, a second tube 46 that leads to a point near the top of the body 24 of Jesus, one or more drip wires 48 that are fluid flow connected to the second tube 46, the drip wires 48 passing through the point of the body 24 of Jesus and terminating at the reservoir 44, a second pump 50 that pumps the fluid F from the reservoir 44 and through the second tube 46, the second pump 50 being connected to the source of electrical power. The second pump 50 pumps the fluid F from the reservoir 44 and up through the second tube 46 to the drip wires 48 wherein the fluid F drips down each drip wire 48 and collects in the reservoir 44 and the process begins anew. If desired, the second tube 46 may have a branch point 52 for sending the fluid F to both the left side and the right side of the body 24 of Jesus and a collection manifold 54 may be employed to catch the fluid F from the various drip wires 48 and to channel the fluid F to the reservoir 44. The fluid F, which is red in color, simulates blood passing out through the body 24 of Jesus. One or both of the fluid flow systems can be used.

Each of the electrical components, light bulb 26, solenoid 36, first pump 42, and second pump 50 is connected to the source of electrical power via the cord 32 and plug 28 in the usual way. A terminal strip 56 is used to electrically connect the various components with the cord 32 and plug 28. The on/off switch 30 controls electrical communication between the source of electrical power and the various components.

In operation, the religious lamp with fluid flow 10 of the present invention is used as a standard lamp. The light bulb 26 is turned on via the on/off switch 30 and when the light bulb 26 is switched on, the solenoid 36 activates in order to tilt the head 34 of Jesus 24 upwardly. Additionally, the first pump 42 and/or the second pump 50 is activated in order to circulate fluid through the fluid flow systems to simulate blood flowing out of the body 24 of Jesus. When the light bulb 26 is switched off, the solenoid 36 tilts the head 34 of Jesus 24 back down and the first pump 42 and/or the second pump 50 are deactivated in order to halt the flow of the simulated blood F.

The religious lamp with fluid flow 10 may have a music box located therein so that whenever the light bulb 26 is activated, music, specifically, appropriate religious or gospel music is played. Additionally, the base 12 may have wheels thereon so that if the religious lamp with fluid flow 10 is of sufficient size, namely life size or larger, the religious lamp with fluid flow 10 can be readily moved about on the wheels.

While the invention has been particularly shown and described with reference to an embodiment thereof, it will be appreciated by those skilled in the art that various changes in form and detail may be made without departing from the spirit and scope of the invention.

I claim:

1. A lamp comprising:

a base;

a cross extending upwardly from the base;

a representation of a body of a human crucified upon the cross;

a light bulb attached to the cross, the light bulb adapted to be electrically connected to a source of electrical power for energizing the light bulb; and a fluid flow system that circulates a fluid therethrough and causes the fluid to pass out through a point of the body of the human wherein the fluid flow system comprises a closed loop tube that passes through the point of the body of the human and a pump that pumps the fluid through the tube, the pump adapted to be connected to the source of electrical power.

2. The lamp as in claim 1 wherein the head of the body of the human tilts upwardly whenever the light bulb is energized and tilts downwardly whenever the light bulb is not energized.

3. The lamp as in claim 2 wherein a solenoid controls the tilting of the head of the body of the human, the solenoid being electrically connected with the light bulb.

4. The lamp as in claim 1 further comprising an on/off switch disposed between the light bulb and the source of electrical power for controlling the electrical communication between the light bulb and the source of electrical power.

5. The lamp as in claim 1 wherein the human is Jesus.

6. A lamp comprising:

a base;

a cross extending upwardly from the base;

a representation of a body of a human crucified upon the cross;

a light bulb attached to the cross, the light bulb adapted to be electrically connected to a source of electrical power for energizing the light bulb;

a reservoir for holding the fluid;

a tube that leads to a top of the body of the human;

a drip wire that is fluid flow connected to the tube, the drip wire passing through the point of the body of the human and terminating at the reservoir;

a pump that pumps the fluid from the reservoir and through the tube, the pump adapted to be connected to the source of electrical power; and wherein the pump pumps the fluid from the reservoir and up through the tube to the drip wire wherein the fluid drips down the drip wire and collects in the reservoir.

7. The lamp as in claim 6 wherein the head of the body of the human tilts upwardly whenever the light bulb is energized and tilts downwardly whenever the light bulb is not energized.

8. The lamp as in claim 7 wherein a solenoid controls the tilting of the head of the body of the human, the solenoid being electrically connected with the light bulb.

9. The lamp as in claim 6 further comprising an on/off switch disposed between the light bulb and the source of electrical power for controlling the electrical communication between the light bulb and the source of electrical power.

10. The lamp as in claim 6 wherein the human is Jesus.

11. A lamp comprising:

a base;

a cross extending upwardly from the base;

a representation of a body of a human crucified upon the cross;

a light bulb attached to the cross, the light bulb adapted to be electrically connected to a source of electrical power for energizing the light bulb;

a first fluid flow system that circulates a first fluid therethrough and causes the first fluid to pass out through a first point of the body of the human; and a second fluid flow system that circulates a second fluid therethrough and causes the second fluid to pass out through a second point of the body of the human.

12. The lamp as in claim 11 wherein the head of the body of the human tilts upwardly whenever the light bulb is energized and tilts downwardly whenever the light bulb is not energized.

13. The lamp as in claim 12 wherein a solenoid controls the tilting of the head of the body of the human, the solenoid being electrically connected with the light bulb.

14. The lamp as in claim 11 further comprising an on/off switch disposed between the light bulb and the source of electrical power for controlling the electrical communication between the light bulb and the source of electrical power.

15. The lamp as in claim 11 wherein the human is Jesus.

16. The lamp as in claim 11 wherein the first fluid flow system comprises a closed loop first tube that passes through the first point of the body of the human and a first pump that pumps the first fluid through the first tube, the first pump adapted to be connected to the source of electrical power and the second fluid flow system comprises a reservoir for holding the second fluid, a second tube that leads to a top of the body of the human, a drip wire that is fluid flow connected to the second tube, the drip wire passing through the second point of the body of the human and terminating at the reservoir, a second pump that pumps the second fluid from the reservoir and through the second tube, the second pump adapted to be connected to the source of electrical power, and wherein the second pump pumps the second fluid from the reservoir and up through the second tube to the drip wire wherein the second fluid drips down the drip wire and collects in the reservoir.

17. The lamp as in claim 16 wherein the head of the body of the human tilts upwardly whenever the light bulb is energized and tilts downwardly whenever the light bulb is not energized.

18. The lamp as in claim 17 wherein a solenoid controls the tilting of the head of the body of the human, the solenoid being electrically connected with the light bulb.

* * * * *